US006045160A

United States Patent [19]

Weeks

[11] Patent Number: 6,045,160

[45] Date of Patent: Apr. 4, 2000

[54] BINDER

[76] Inventor: Helen Weeks, 14020 174th St., Jamaica, N.Y. 11434

[21] Appl. No.: 09/048,209

[22] Filed: Mar. 26, 1998

[51] Int. Cl.[7] ..... B42D 3/00

[52] U.S. Cl. ..... 281/29; 281/31; 281/37; 281/38; 402/79

[58] Field of Search ..... 281/29, 31, 37; 206/472, 473, 455, 232; 402/73, 70, 79

[56] References Cited

U.S. PATENT DOCUMENTS

| | | | |
|---|---|---|---|
| 4,164,085 | 8/1979 | Steep et al. | 40/152 |
| 4,255,872 | 3/1981 | Williams, Sr. | 434/308 |
| 4,470,620 | 9/1984 | Gerch | 281/31 |
| 4,629,349 | 12/1986 | Pitts | 402/74 |
| 4,640,413 | 2/1987 | Kaplan et al. | 206/232 |
| 4,907,904 | 3/1990 | Baldwin | 402/80 R |
| 5,236,226 | 8/1993 | Sheffield | 281/48 |
| 5,294,208 | 3/1994 | Tremmel, Jr. et al. | 402/70 |
| 5,350,249 | 9/1994 | Peters | 402/4 |
| 5,466,008 | 11/1995 | Ozeki | 281/31 |
| 5,762,375 | 6/1998 | Kogutt et al. | 281/37 |

*Primary Examiner*—Willmon Fridie, Jr.

[57] ABSTRACT

A new binder for holding articles such as a Bible or other religious text, note pads, and tracts in pockets disposed on the outside surfaces of the front and back cover. The device includes a front cover and a back cover hingedly attached to a spine, a plurality of open-ended sleeves hingedly attached to the spine between the front and back covers, and at least a first pocket disposed upon a front cover outside surface.

1 Claim, 2 Drawing Sheets

BINDER

BACKGROUND OF THE INVENTION

1. Field of the Invention

The present invention relates to binders of the type for holding periodicals and the like and more particularly pertains to a new binder for holding articles such as a Bible or other religious text, note pads, and tracts in pockets disposed on the outside surfaces of the front and back cover.

2. Description of the Prior Art

The use of binders is known in the prior art. More specifically, binders heretofore devised and utilized are known to consist basically of familiar, expected and obvious structural configurations, notwithstanding the myriad of designs encompassed by the crowded prior art which have been developed for the fulfillment of countless objectives and requirements.

Known prior art binders include U.S. Pat. No. 3,950,012; U.S. Pat. No. Des. 318,687; U.S. Pat. No. 4,659,109; U.S. Pat. No. 4,561,623; and U.S. Pat. No. 4,138,143.

While these devices fulfill their respective, particular objectives and requirements, the aforementioned patents do not disclose a new binder. The inventive device includes a front cover and a back cover hingedly attached to a spine, a plurality of open-ended sleeves hingedly attached to the spine between the front and back covers, and at least a first pocket disposed upon a front cover outside surface.

In these respects, the binder according to the present invention substantially departs from the conventional concepts and designs of the prior art, and in so doing provides an apparatus primarily developed for the purpose of holding articles such as a Bible or other religious text, note pads, and tracts in pockets disposed on the outside surfaces of the front and back cover.

SUMMARY OF THE INVENTION

In view of the foregoing disadvantages inherent in the known types of binders now present in the prior art, the present invention provides a new binder construction wherein the same can be utilized for holding articles such as a Bible or other religious text, note pads, and tracts in pockets disposed on the outside surfaces of the front and back cover.

The general purpose of the present invention, which will be described subsequently in greater detail, is to provide a new binder apparatus and method which has many of the advantages of the binders mentioned heretofore and many novel features that result in a new binder which is not anticipated, rendered obvious, suggested, or even implied by any of the prior art binders, either alone or in any combination thereof.

To attain this, the present invention generally comprises a front cover and a back cover hingedly attached to a spine, a plurality of open-ended sleeves hingedly attached to the spine between the front and back covers, and at least a first pocket disposed upon a front cover outside surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new binder apparatus and method which has many of the advantages of the binders mentioned heretofore and many novel features that result in a new binder which is not anticipated, rendered obvious, suggested, or even implied by any of the prior art binders, either alone or in any combination thereof.

It is another object of the present invention to provide a new binder which may be easily and efficiently manufactured and marketed.

It is a further object of the present invention to provide a new binder which is of a durable and reliable construction.

An even further object of the present invention is to provide a new binder which is susceptible of a low cost of manufacture with regard to both materials and labor, and which accordingly is then susceptible of low prices of sale to the consuming public, thereby making such binder economically available to the buying public.

Still yet another object of the present invention is to provide a new binder which provides in the apparatuses and methods of the prior art some of the advantages thereof, while simultaneously overcoming some of the disadvantages normally associated therewith.

Still another object of the present invention is to provide a new binder for holding articles such as a Bible or other religious text, note pads, and tracts in pockets disposed on the outside surfaces of the front and back cover.

Yet another object of the present invention is to provide a new binder which includes a front cover and a back cover hingedly attached to a spine, a plurality of open-ended sleeves hingedly attached to the spine between the front and back covers, and at least a first pocket disposed upon a front cover outside surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
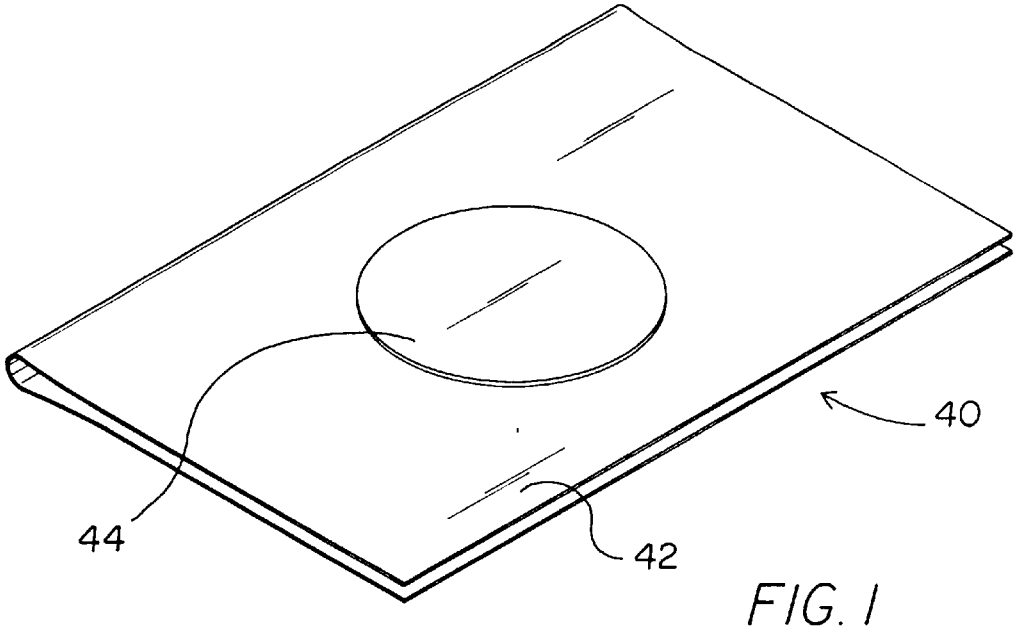
FIG. 1 is a right side perspective view of a new binder according to the present invention.
Figure 2:
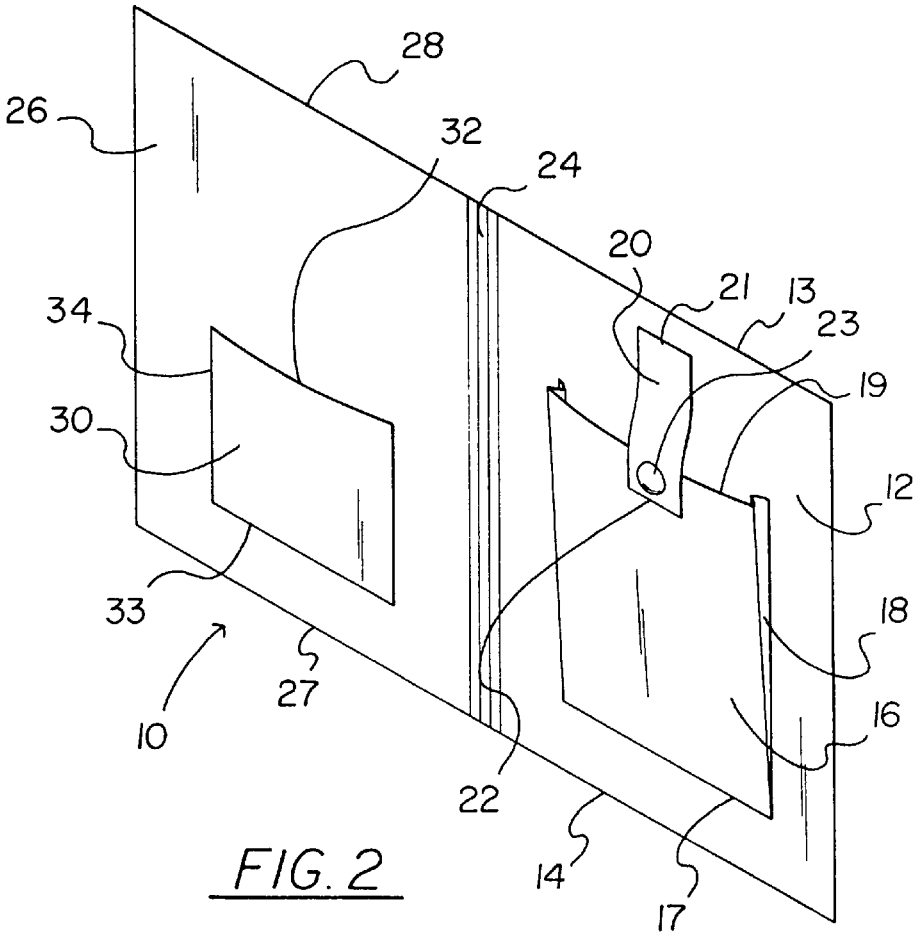
FIG. 2 is an elevation view of an alternative embodiment of the present invention.
Figure 3:
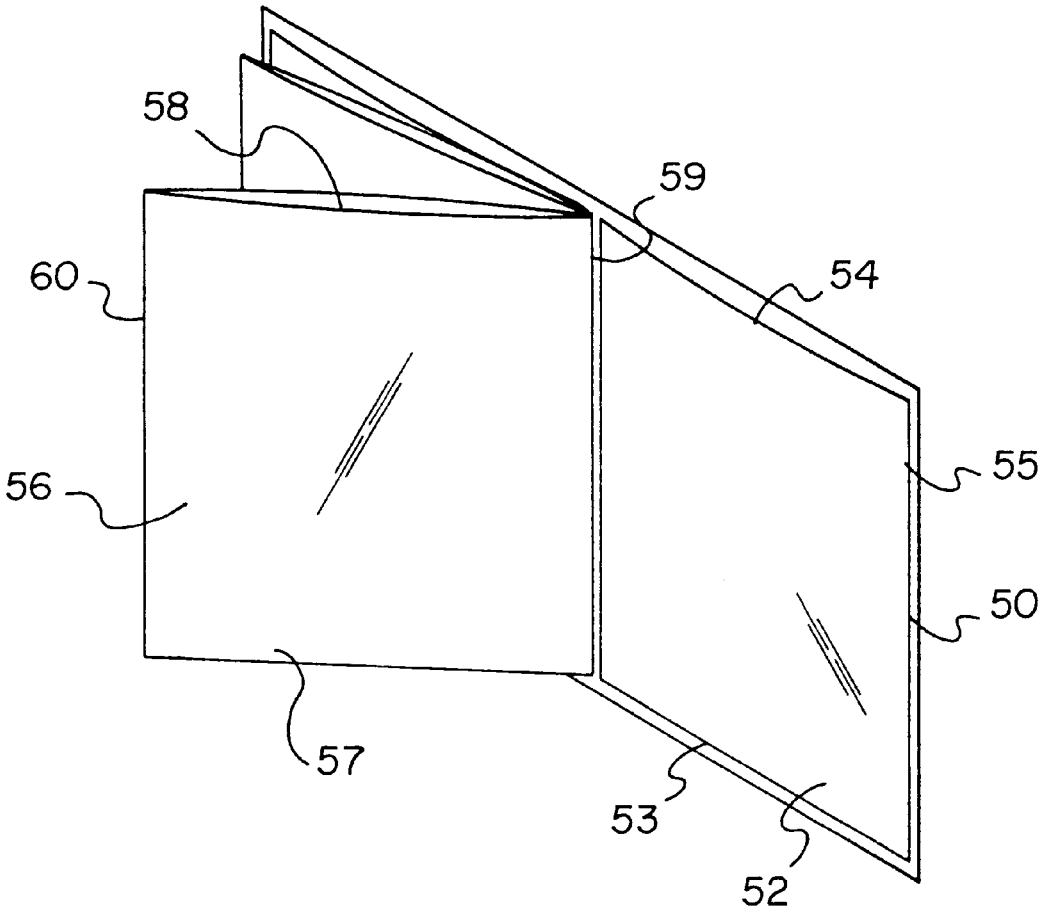
FIG. 3 is an perspective view showing the open-ended sleeves of the present invention.

With reference now to the drawings, and in particular to FIGS. 1 through 3 thereof, a new binder embodying the principles and concepts of the present invention and generally designated by the reference numeral 10 will be described.

More specifically, it will be noted that the binder 10 comprises a front cover 13 and a back cover 28 hingedly attached to a spine 24, a plurality of open-ended sleeves 56 hingedly attached to the spine 24 between the front and back covers 13 and 28, and at least a first pocket 16 disposed upon a front cover outside surface 12.

As best illustrated in FIGS. 1 through 3, it can be shown that the binder 10 is generally of a type well known in the art having a front cover 13, a back cover 28 and a spine 24 formed of a rigid material such as cardboard or a rigid synthetic resin material and being covered by a flexible and weldable material such as a flexible synthetic resin material or a flexible and sewable material such as leather. The front cover 13 and the back cover 28 are shown hingedly attached to the spine 24 as by welding or sewing. Hingedly attached to the spine 24 between the front cover 13 and the back cover 28 are shown a plurality of open-ended sleeves 56 preferably formed of a clear plastic material and being designed for receiving periodicals, papers and the like.

The open-ended sleeves 56 are shown including an open top portion 58, a bottom portion 57 and first and second side portions 59 and 60. Also shown is an inside pocket 52 formed on a back cover inside surface 50. The inside pocket 52 further is shown including a bottom portion 53 and an open top portion 54 for receiving articles such as periodicals, papers, tracts, supplies and the like. Although not shown, the front cover inside surface also includes an inside pocket of similar construction to the inside pocket 52.

As best illustrated in FIG. 2 a first pocket 16 is shown disposed upon a front cover outside surface 12. The first pocket 16 includes a bottom portion 17, side portions 18 and an open top end 19 designed for receiving a Bible or other religious text. A means for securing the first pocket open end 19 to the front cover outside surface 12 is shown including a strap 20 fixedly attached to the front cover outside surface 12 at a strap first end 21. A strap second end 22 is shown attachable to the first pocket open end 19 by means of a snap 23. Other means of attaching the strap second end 22 to the first pocket open end 19 include a system of hooks and eyes.

With continued reference to FIG. 2 a second pocket 30 is shown disposed upon a back cover outside surface 26. The second pocket 30 includes a bottom portion 33, side portions 34 and a second pocket open end 32 designed for receiving papers, tracts and the like.

With reference to FIG. 1 there is shown an alternative embodiment 40 of the present invention including an embossed emblem 44 shown disposed on a front cover outside surface 42.

In use, periodicals, papers and the like can be held in the open-ended sleeves 56 as well as in the inside pockets 52. A bible or other religious text can be held in the first pocket 16 and secured therein by means of snapping the snap 23 to the first pocket open end 19. Tracts and other materials can be held in the second pocket 30.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A binder comprising:

a front cover and a back cover hingedly attached to a spine;

a plurality of open-ended sleeves hingedly attached to the spine, the open-ended sleeves being disposed between the front cover and the back cover;

a second pocket disposed upon a back cover outside surface;

a first inside pocket formed on a front cover inside surface; and a second inside pocket formed on a back cover inside surface; and an embossed emblem formed on a front cover outside surface.

* * * * *